US006580210B1

(12) United States Patent
Houben et al.

(10) Patent No.: US 6,580,210 B1
(45) Date of Patent: Jun. 17, 2003

(54) METHOD OF MANUFACTURING AN ELECTRON GUN, ELECTRON GUN, DISPLAY DEVICE WITH SUCH AN ELECTRON GUN, AND SUB-ASSEMBLY FOR USE IN SUCH AN ELECTRON GUN

(75) Inventors: Johannes Peter Lodevicus Houben, Eindhoven (NL); Marinus Adrianus Maria Van De Veerdonk, Eindoven (NL)

(73) Assignee: Koninklijke Philips Electronics N.V., Eindhoven (NL)

( * ) Notice: Subject to any disclaimer, the term of this patent is extended or adjusted under 35 U.S.C. 154(b) by 287 days.

(21) Appl. No.: 09/590,253

(22) Filed: Jun. 8, 2000

(30) Foreign Application Priority Data

Jun. 10, 1999 (EP) ..... 99201844

(51) Int. Cl.[7] ..... H01J 31/00; H01J 29/46; H01J 1/18; H01J 9/12

(52) U.S. Cl. ..... 313/482; 313/456; 313/457; 313/451; 313/269; 445/34

(58) Field of Search ..... 313/456, 457, 313/482, 451, 269; 445/34

(56) References Cited

U.S. PATENT DOCUMENTS 2,802,133 A * 8/1957 Haas ..... 313/317
4,082,977 A * 4/1978 Blumenberg ..... 313/417
4,479,073 A * 10/1984 Van Daelen ..... 313/270
4,633,132 A * 12/1986 Marks et al. ..... 313/318.01

* cited by examiner

*Primary Examiner*—Nimeshkumar D. Patel
*Assistant Examiner*—Matt Hodges

(57) ABSTRACT

A method of manufacturing an electron gun having a sub-assembly to interconnect the beaded unit and the base of the electron gun. This sub-assembly is manufactured by making a pattern of apertures in a planar element, thereby forming a number of securing elements. In the next step, portions of the securing elements are bent out of the plane of the planar element and then connected to an insulating plate, thus forming the sub-assembly of securing elements and insulating plate. This sub-assembly is preferably provided with funnel-shaped apertures to lead the electric leads of a number of gun electrodes through the insulating plate. This allows an accurate and easy interconnection of the electric leads and the pins of the base.

20 Claims, 7 Drawing Sheets

METHOD OF MANUFACTURING AN ELECTRON GUN, ELECTRON GUN, DISPLAY DEVICE WITH SUCH AN ELECTRON GUN, AND SUB-ASSEMBLY FOR USE IN SUCH AN ELECTRON GUN

BACKGROUND OF THE INVENTION

This invention relates to a method of manufacturing an electron gun having a beaded unit comprising a number of electrodes connected to electric leads and secured to beading rods, and a base comprising a number of pins, which beaded unit and base are connected by means of a sub-assembly of securing means and an insulating plate.

The invention also relates to an electron gun having a beaded unit comprising a number of electrodes connected to electric leads and secured to beading rods, and a base comprising a number of pins, which beaded unit and base are connected by means of a sub-assembly of securing means and an insulating plate, to a display device provided with such an electron gun and to a sub-assembly for use in such an electron gun.

Such display devices may be cathode ray tubes for use in, for instance, television sets and computer monitors.

An electron gun as described above is disclosed in U.S. pat. No. 4,082,977. The known electron gun according to said patent is provided with securing means for connecting the beaded unit to the base. Said securing means comprise an insulating plate with a number of apertures. Some of the apertures in the insulating plate correspond to the pins of the base. These apertures are provided with a metal eyelet, secured to the insulating plate, for instance, by clamping. These eyelets are used for connecting the insulating plate to the base, for instance, by welding the pins to the eyelets. The remaining apertures in the insulating plate are also provided with eyelets and are meant to engage the standards of the beaded unit of the electron gun, in a way that resembles male-female socket components. It is also possible to provide the insulating plate with electric contacts. Although said patent describes an electron gun with a connection between the beaded unit and the base, it also has some drawbacks. Primarily, this construction is used for making the connection between the standards of the beaded unit and the base; the electric leads from the electrodes of the beaded unit are mostly directly connected to the pins of the base or to the eyelets. Moreover, the construction is rather complicated, including a large number of eyelets in the insulating plate.

Conventional electron guns used in cathode ray tubes (CRTs) comprise a number of electrodes which are positioned one behind the other, starting from the (at least one) cathode and ending at the anode, which is the final accelerating electrode. If the CRT is a monochromatic tube, only one cathode is present; in the well-known color CRT, the electron gun will generate three electron beams—one for each color of electroluminescent material on the screen—i.e, the electron gun has three cathodes. The electrodes in an electron gun are mechanically interconnected during the beading process, by partly embedding the electrodes in a number of beading rods, resulting in the sub-assembly that is usually referred to as the beaded unit. This beaded unit has to be secured to the base, which base normally comprises a glass base plate and a number of electric leads, commonly referred to as the pins.

The step in the known manufacturing process of electron guns, in which the beaded unit is secured to the base, is time-consuming and, as a consequence, rather expensive. Moreover, since it is a largely manual process, it also introduces spreads in the quality of the final product.

SUMMARY OF THE INVENTION

It is an object of the invention to provide a method of manufacturing an electron gun, which is improved with respect to the method as described in the opening paragraph, and in which the above-mentioned problems will be largely reduced or even solved.

According to the invention, a method for manufacturing an electron gun that realizes this object is characterized in that

- a pattern of openings is provided in a planar element, thereby forming a number of securing means, still planar-shaped, attached to a remainder of the planar element,
- portions of said securing means are bent out of the plane of the planar element, to provide the securing means with a three-dimensional shape,
- the securing means are inserted into a plurality of first apertures of the insulating plate and secured therein to form the sub-assembly
- the sub-assembly of securing means and insulating plate is disconnected from the remainder of the planar element, and
- the sub-assembly of securing means and insulating plate is connected to the beaded unit and the base, to form the electron gun.

For connecting the beaded unit of the electron gun to its base, this method uses an insulating plate provided with apertures which engage a number of securing means. These securing means may be fixed to the insulating plate by twisting the ends of the securing means, thus forming said sub-assembly. These securing means, positioned between the beaded unit and the base, are connected at one side to the beaded unit and at the other side to the pins of the base. Most current electron guns do not comprise this sub-assembly of securing means and insulating plate. In these electron guns, the beaded unit is directly connected to the pins of the base. This part of the process has to be done largely by hand and is very difficult to mechanize, so that it is a time-consuming and expensive step in the manufacturing process of electron guns. Besides these aspects, the manual treatment of an electron gun at this stage of the production process introduces an undesired spread of some important mechanical parameters of the electron guns that partly determine the performance in the final product. The increasingly stricter requirements imposed on the performance of electron guns—spot sizes, mechanical stability, high voltage behavior—makes it necessary to improve the connection between the beaded unit and the base in order to fulfill the requirements for future designs of electron guns.

The invention is based on the recognition that the introduction of an intermediate sub-assembly of securing means and insulating plate provides a manufacturing method that will largely overcome the drawbacks of the known method. This is motivated by the fact that the sub-assembly of securing means and insulating plate can easily be made with a high accuracy. The process in which this sub-assembly is connected to the beaded unit and to the base, for instance, by means of a welding process, can then be done in a mechanized way with a much higher accuracy and a much higher speed than manual mounting of these components. The higher accuracy of this process improves the performance of the gun in the CRT. For instance, one of the items that are improved is the phenomenon which is usually referred to as delta-$V_{co}$. Delta-$V_{co}$, is understood to be the difference in cut-off voltage between the three cathodes of a color CRT, causing an unbalance in the drive of the three electron beams, leading to a shift in color at different brightness levels. This phenomenon is clearly negatively influenced by manual actions during the manufacturing process. Another advantage of this method is that the mechanized method of interconnecting the beaded unit to the base can lead to an electron gun that is at least 2 mm shorter than electron guns that are manufactured without said sub-assembly.

An embodiment of the method according to the present invention is characterized in that the insulating plate has a plurality of second apertures for leading through the electric leads of a number of the electrodes. An embodiment like this makes it possible to guide electric leads through these apertures in the insulating plate, so that the electric leads can be connected, for instance by welding, to the securing means, which themselves are connected to the pins of the base. In this way, an electrical connection is formed from the outside of the display device to the proper electrode. Consequently, the securing means have to be electrically conductive, and are preferably made of metal.

A further embodiment of the method according to the present invention is characterized in that the apertures in the insulating plate are funnel-shaped. The funnel-shaped apertures make the assembly process easier, because both the securing means and the electric leads will be more easily guided through the apertures in the insulating plate.

A further embodiment of the method according to the present invention is characterized in that the first apertures in the insulating plate are tapered in a direction away from the base and the second apertures are tapered in a direction towards the base. Making the tapers in these directions is preferred, because the securing means enter the insulating plate from the side of the base, while the electric leads enter the securing means from the side of the beaded unit.

A still further embodiment of the method according to the present invention is characterized in that the pattern of openings in the planar element is obtained by stamping the openings in the planar element. Stamping the opening in the planar element has a great advantage from an industrial point of view. It is an easy method that can be performed in a mechanized way with high accuracy and at high speed. Besides, it is possible to produce these planar elements from a tape of metal on a reel. Of course, these planar elements may be produced by using other manufacturing methods like etching, which yields products with high accuracy and without mechanical stresses, but an etching process will be more expensive.

The invention also relates to an electron gun having a beaded unit comprising a number of electrodes connected to electric leads and secured to beading rods, and a base comprising a number of pins, which beaded unit and base are connected by means of a sub-assembly of securing means and an insulating plate, characterized in that the insulating plate is provided with a plurality of first apertures that let through the securing means, and a plurality of second apertures that let through the electric leads of a number of the electrodes, said electric leads being connected to the securing means which are connected to pins of the base.

Furthermore, the invention relates to a display device provided with such an electron gun. The invention also relates to a sub-assembly for use in such an electron gun.

These and other aspects of the invention are apparent from and will be elucidated by way of non-limitative examples with reference to the drawings and the embodiments described hereinafter.

DESCRIPTION OF THE PREFERRED EMBODIMENTS

Figure 1:
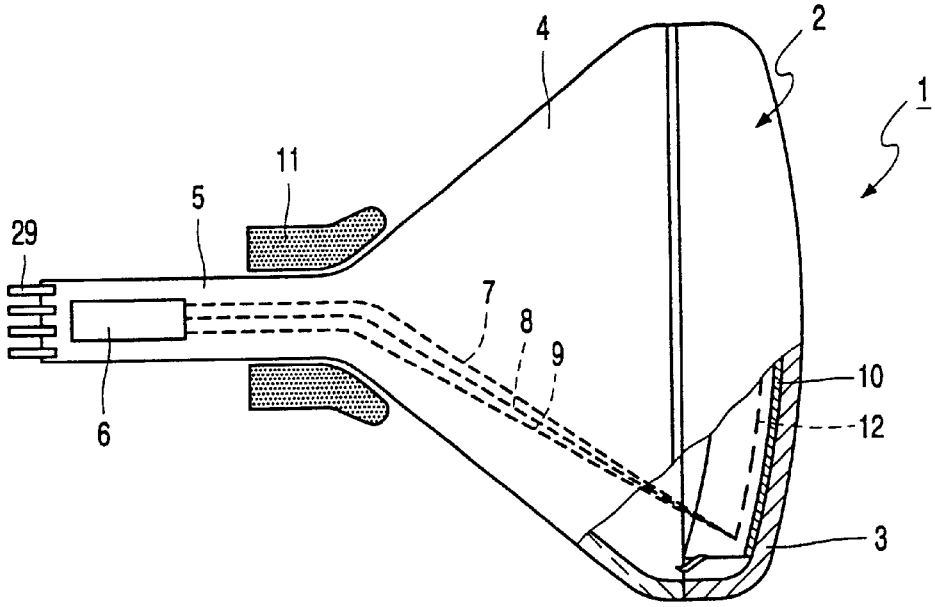
FIG. 1 is a side elevation, partly broken away, of a color display device with an electron gun according to the invention.

The cathode ray tube 1 shown in FIG. 1 comprises an evacuated glass envelope 2 with a neck 5, a funnel-shaped part 4 and a front panel 3, which may be either curved or flat. A display screen 10 having a pattern of, for example, lines or dots of phosphors luminescing in different colors—e.g. red, green and blue—may be arranged on the inside of the panel. A mask 12 is positioned at a distance from the display screen 10. The mask 12 may be an apertured mask having circular or elongate apertures, or a wire mask. During operation of the tube, an electron gun 6 arranged in the neck 5 and connected via pins 29 to external power supplies, sends electron beams 7, 8, 9 through the mask 12 to the display screen 10 so that the phosphors will emit light. The electron beams have a mutual angle causing, at the proper mask to screen distance, the electron beams to only impinge on the phosphors of the associated color. A deflection device 11 ensures that the electron beams systematically scan the display screen 10.

The term electron gun should be considered to have a broad meaning. For instance, it may refer to an electron gun of a color picture tube as given in FIG. 1 and described above or of a monochromatic tube in which the electron gun generates one electron beam only. The present invention is also applicable to other types of display devices comprising an electron gun that generates one or more electron beams. Here, the three-color electron gun will be used to illustrate the invention, but this should not be considered to be restrictive.

Figure 2:
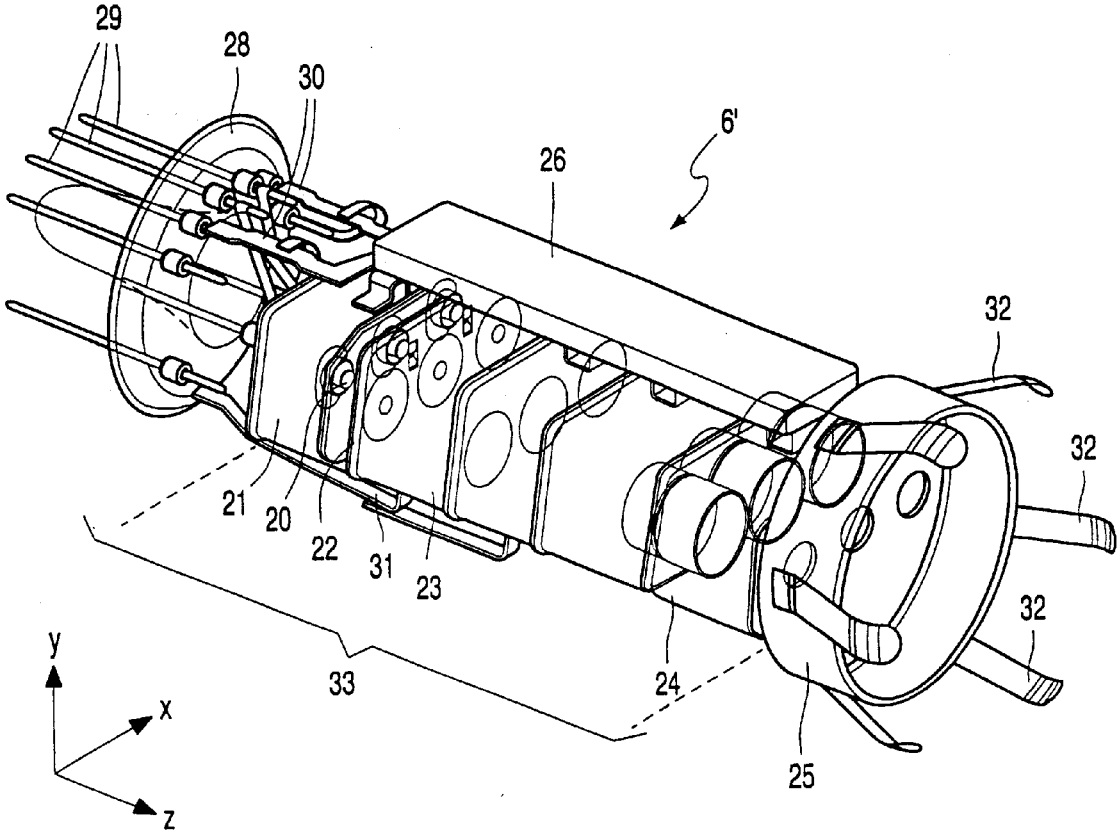
FIG. 2 is a schematical and semi-transparent perspective view of a prior-art electron gun.

FIG. 2 shows a prior-art electron gun 6' for use in a color CRT. This is a schematical and semi-transparent drawing serving as an example only. Such an electron gun 6' comprises a beam-generating region, mostly called the triode. This triode consists of three inline electron sources 20, e.g. cathodes, a first electrode 21 and a second electrode 22. In most current electron guns, the first electrode 21 is called grid 1 (G1) and is connected to ground; the second electrode 22 (G2) is mostly connected to a potential in the range of 500–1000 V. The gun also comprises a beam forming or prefocusing section. In this example, the prefocusing section has a prefocusing lens formed by the electrodes 22 and 23, in which electrode 23 is the focus electrode, normally provided with an operating potential between 5 kV and 9 kV. The main lens system of the electron gun 6' is the main focusing section of the gun; it creates a focused image of the virtual object as generated by the triode section. The main lens system is formed in the region comprising the focus electrode 23 and an accelerating electrode 24, also referred to as the anode electrode. A typical operation voltage range for the anode electrode is 25–35 kV.

In the manufacturing .process of electron guns, the electrodes 21–24 are interconnected by the beading rods, also referred to as multiform rods, 26. In this process, the beading rods, usually made of glass, are heated until they are softened to such a degree that it becomes possible to press them over the stack of electrodes that are positioned in a jig and kept at the chosen distance from each other by applying spacers in between the electrodes. After the glass has cooled down, the jig and spacers are removed and the beaded unit 33 results. The next step in the manufacturing process is mounting the cathodes 20 in the beaded unit 33. Then the beaded unit 33 is connected to a base 28, comprising the pins 29. The mechanical stability of the beaded unit 33 on the base 28 is provided by the brackets 30 that are connected at one end to the beading rods 26, and at the other end to the pins 29. In general, these brackets are also used for the electric leads between the pins 29 and the electrodes. Besides these electric leads, the electron gun 6' also comprises leads, like for instance 31, that are not connected to the brackets supporting the beaded unit 33. The final step in the manufacturing process of an electron gun is the mounting of the centering cup 25 which comprises the centering springs—or snubbers—32. These centering springs ensure that the z-axis of the electron gun 6 coincides substantially with the z-axis of the CRT 1.

The improved manufacturing method for an electron gun, as is disclosed in this invention, will be described step by step by making use of FIGS. 3–11. Starting from a flat metal plate, called the planar element, the process steps that will yield the sub-assembly of securing means and the insulating plate as an intermediate product and an assembled electron gun as final product, will be described.

Figure 3:
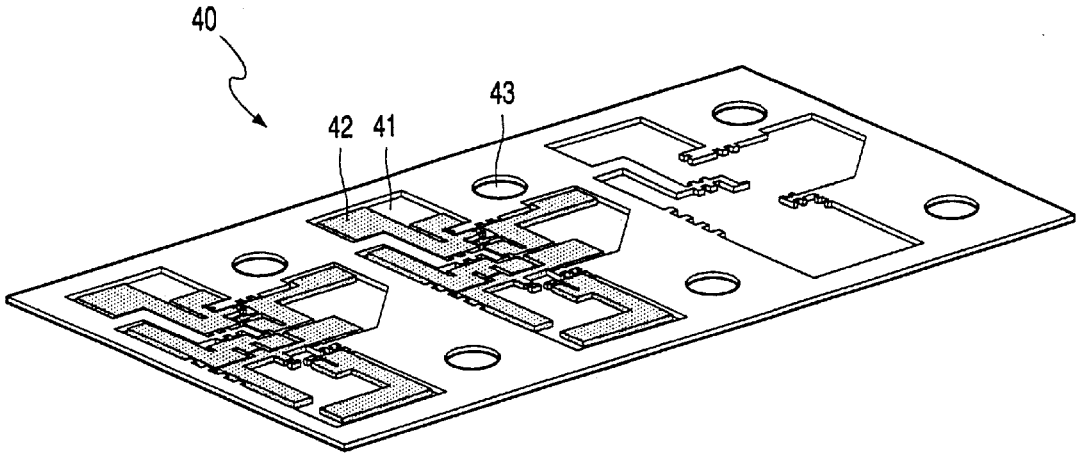
FIG. 3 is a perspective view of a set of planar elements.

FIG. 3 shows a set of planar elements. For example, this Figure shows a part of a tape with the positions for three planar elements. At two positions, the securing means 42 are still present, while the securing means have been removed at the third position. The openings 41 in the planar element 40 are preferably made by stamping. The advantage of stamping the openings is that the mechanization of this process is improved. It is possible to use a tape of metal on a reel and to transport this tape over a stamping device. The additional openings 43 are made for transporting the tape. FIG. 3 shows a part of such a tape having three planar element positions. The securing means, here still in planar form, are denoted by 42. These securing means 42 are still connected to the planar element 40 by small bridges, which will be cut loose after mounting the insulating plate. The securing means on the right have been left out only for reasons of illustration. Within the framework of the invention, the openings could also be made by means of other methods, for instance by etching, cutting or laser-cutting.

Figure 4:
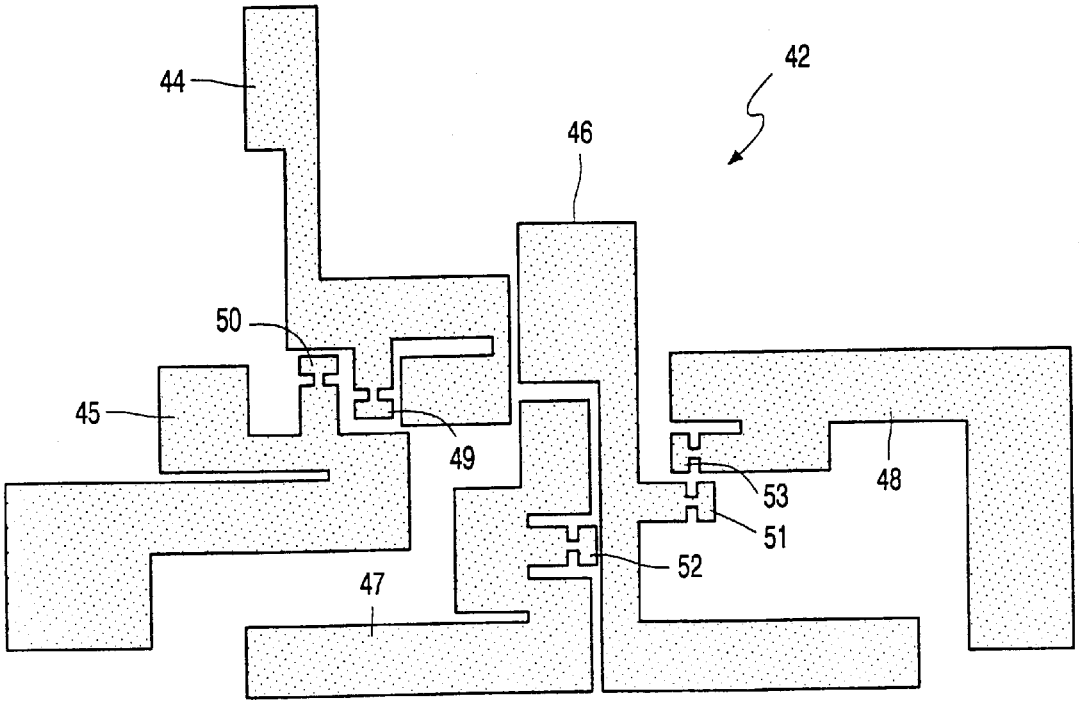
FIG. 4 is a top view of the securing means.

FIG. 4 is a top view, with the same orientation as FIG. 3, of the securing elements 42 in planar form. In this example the form that is stamped from the planar element comprises five securing means, denoted by 44–48. Each securing means is provided with a locking element 49–53 to fix the securing means to the insulating plate.

Figure 5:
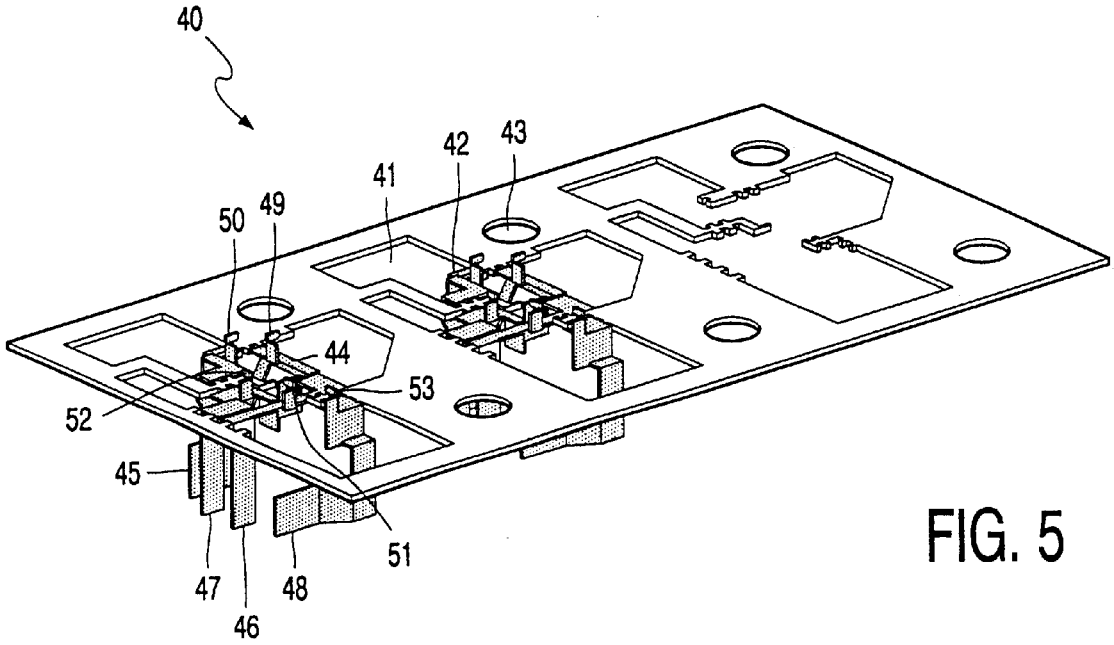
FIG. 5 is a perspective view of a planar element after bending of the securing means.
Figure 6:
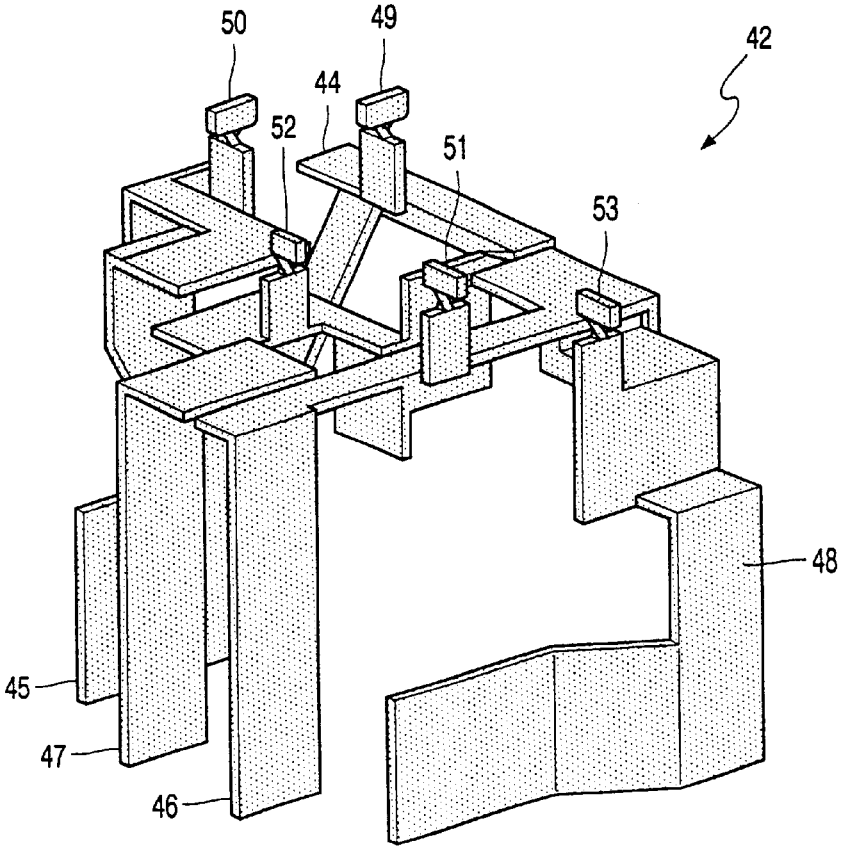
FIG. 6 is a perspective view of the securing means without the insulating plate.
Figure 7:
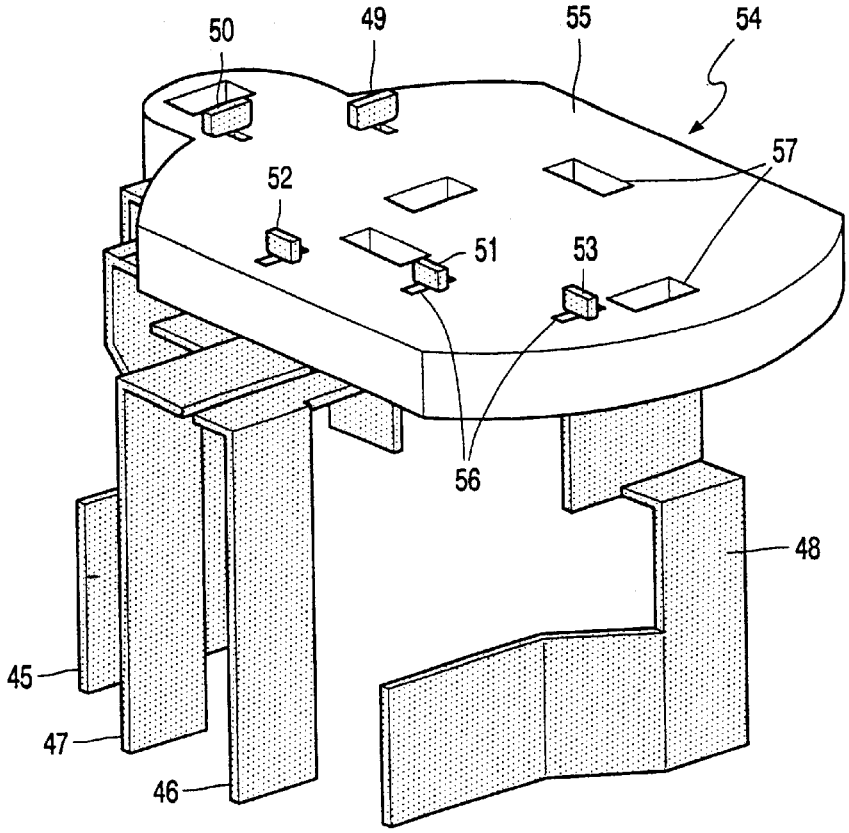
FIGS. 7 and 8 are perspective views from the top and bottom side of the securing means, including the insulating plate.

After the securing means 42 have been stamped, they are bent in the form that is needed for application in the electron gun 6. This is illustrated in FIG. 5. The securing means are still connected to the planar element 40. It can easily be seen that the locking elements 49–53 are in one plane. FIG. 6 is a perspective view of one set of securing means 42 separated from the planar element 40. This Figure illustrates the set of securing means 42 needed for one electron gun 6. In the Figure, the locking elements 49–53 are twisted through approximately 90°; in the production process, this twisting takes place after the insulating plate has been mounted. The situation with the insulating plate 55 mounted and fixed to the set of securing means 42 is shown in FIG. 7. The locking elements 49–53 twisted through approximately 90° clearly show that in this way the insulating plate 55 is rigidly fixed to the set of securing means 42. This way of connecting the securing means 42 and the insulating plate 55 only serves as an example and a lot of alternatives can be found within the scope of this invention. Since the securing means will be used in the electron gun as electric leads for the voltages as well, it is necessary that the insulating plate 55 is indeed insulating for electric currents. The insulating plate 55 can, for instance, be made of a ceramic material. This is the sub-assembly 54 of securing means 42 and insulating plate 55, as it will be used in an electron gun for interconnecting the beaded unit 33 and the base 28.

Figure 8:
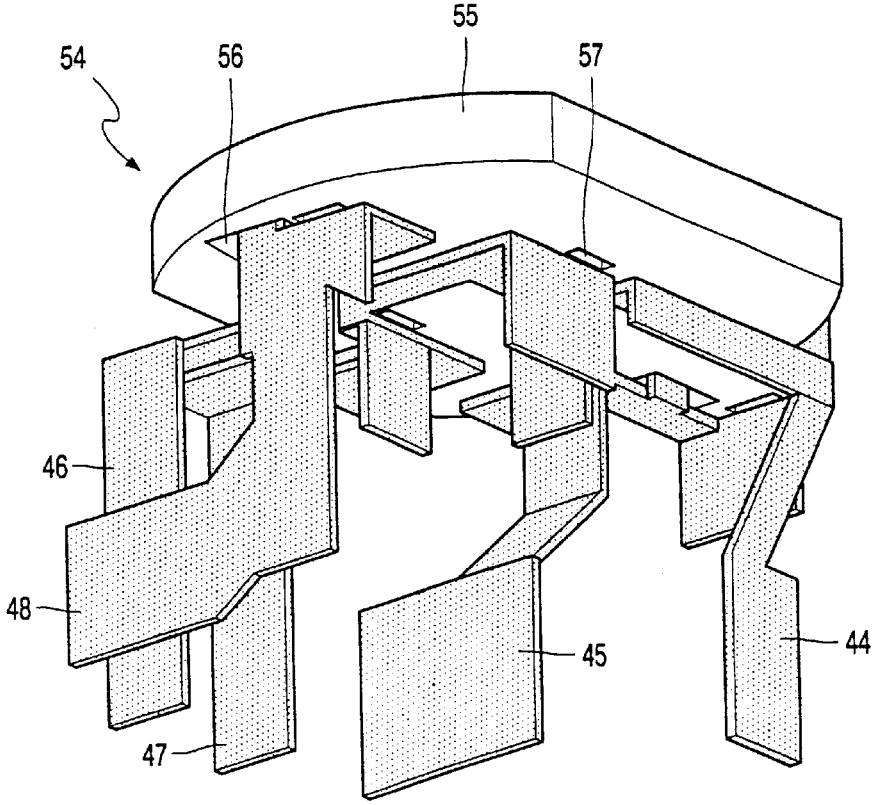

In comparison with FIG. 7, FIG. 8 is a different perspective view of the sub-assembly 54 of securing means 42 and insulating plate 55, now seen from the bottom side and rotated anti-clockwise, through approximately 90°.

The insulating plate 55 is provided with a plurality of apertures 56, 57. On the one hand, the apertures 56 are used for engaging the securing means 42 and realizing the sub-assembly 54 and, on the other hand, the apertures 57 engage the electric leads coming from the electron gun. A preferred embodiment of the insulating plate is provided with funnel-shaped apertures, as can be seen in FIGS. 7 and 8. The apertures 56 have a wider opening at the bottom side of the insulating plate 55 where the securing means penetrate, while the apertures 57 have a wider opening at the top side of the insulating plate 55 where the electric leads penetrate. This simplifies assembly of the securing means 42 and of the beaded unit 33 to the insulating plate 55 because the funnel-shaped apertures will guide the locking elements 49–53 and the electric leads through the apertures.

Figure 9:
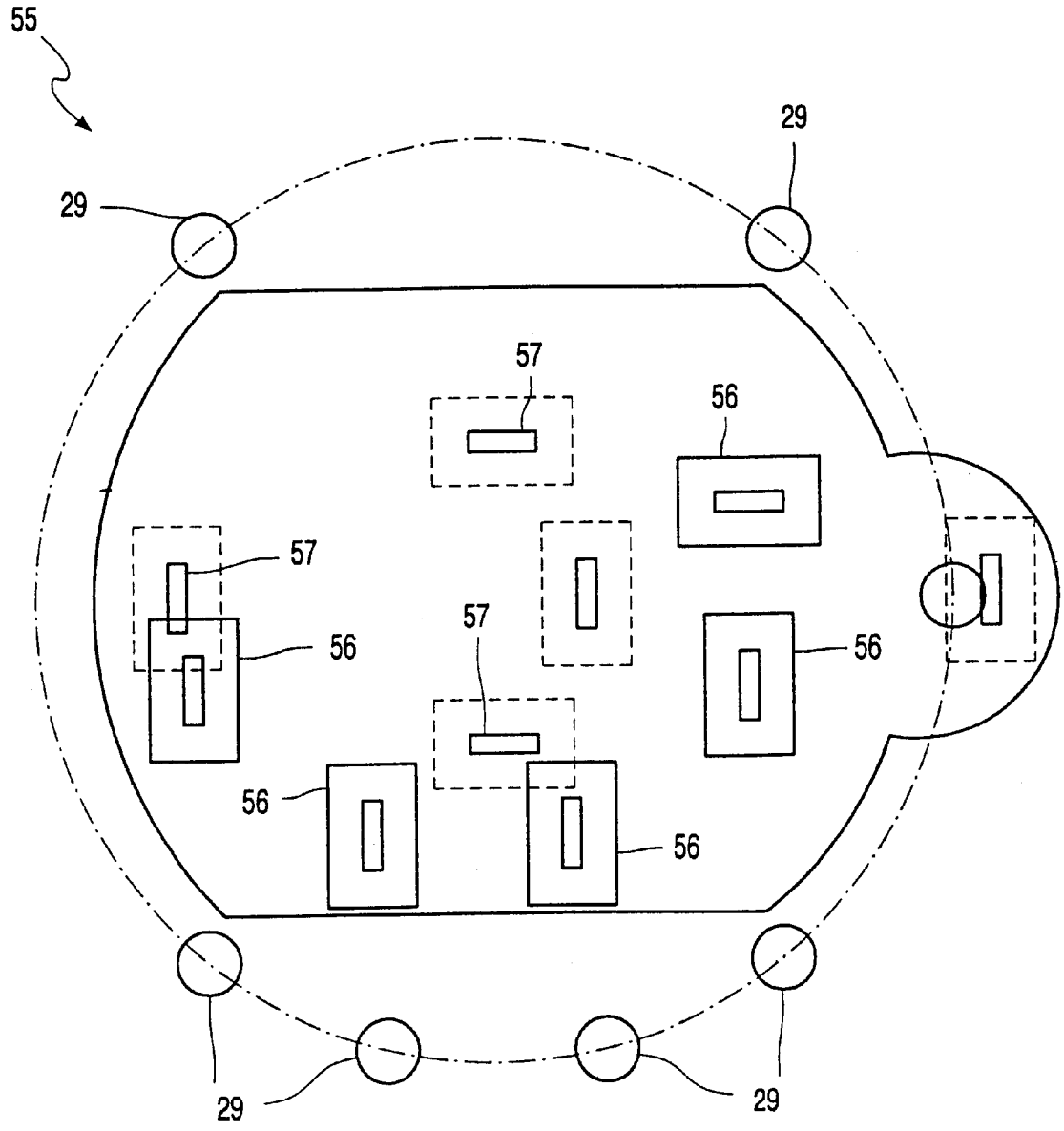
FIG. 9 is a bottom view of the insulating plate with respect to the pins.

By way of example, FIG. 9 shows a lay-out of the bottom side of the insulating plate 55 as can be used in common electron guns for CRTs. It should be noted that, in FIGS. 9 and 10, the configuration of the securing means is slightly different from the one presented in the previous Figures.

Figure 10:
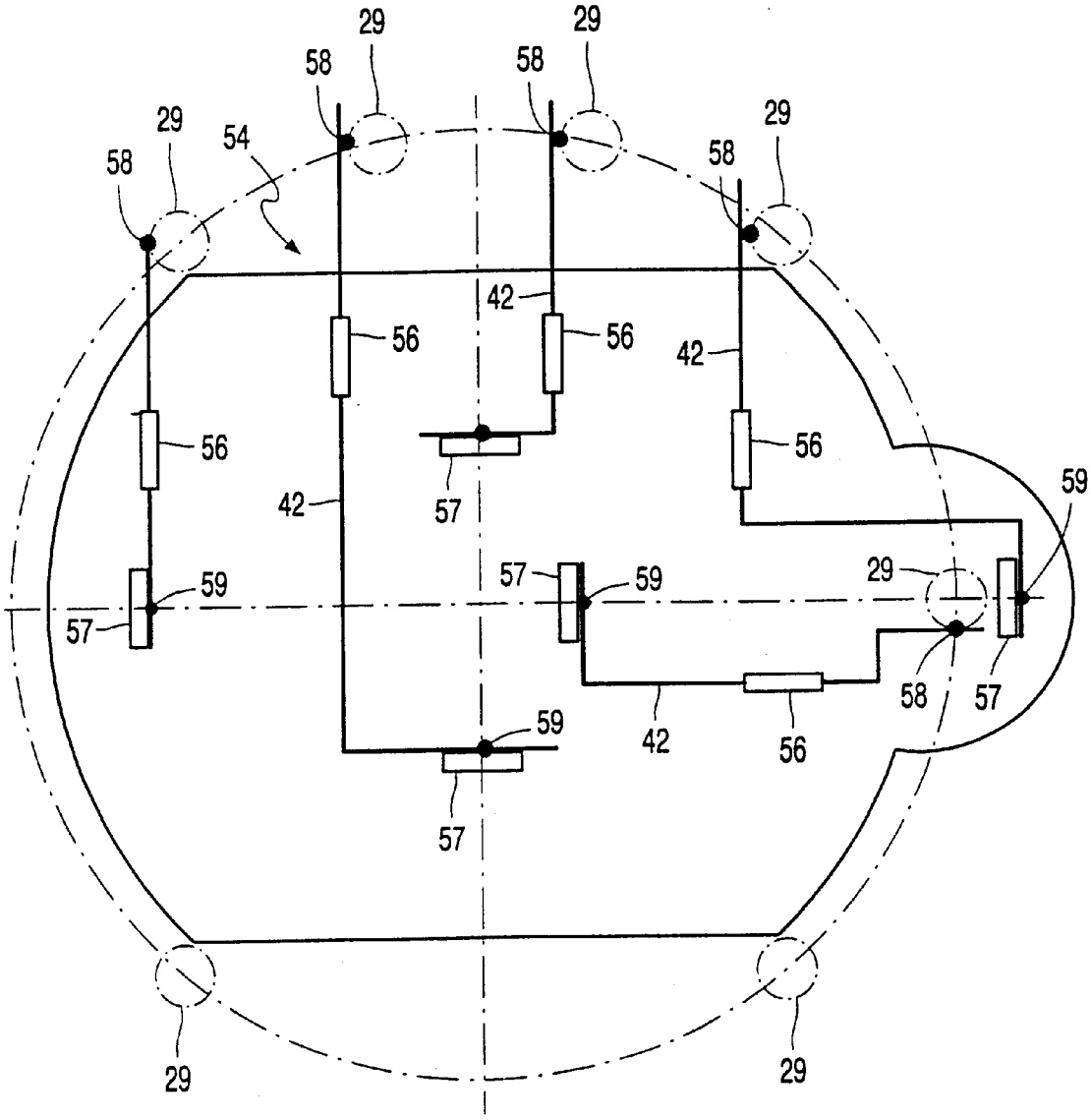
FIG. 10 is a top view of the insulating plate, the securing means, the position of the pins in the base and the welding positions.
Figure 11:
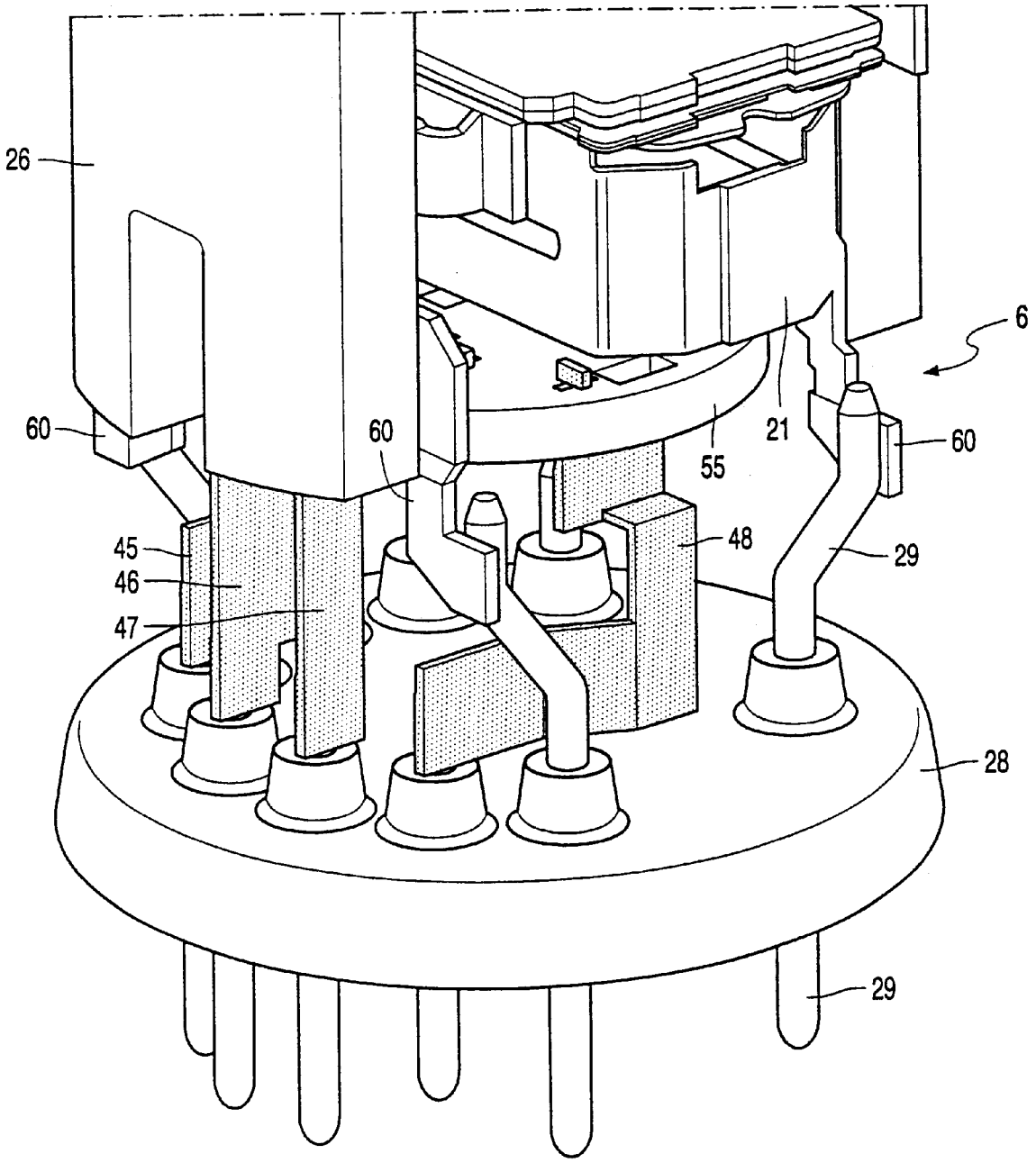
FIG. 11 is a perspective view of a part of the electron gun according to the invention, showing the sub-assembly of securing means and insulating plate, interconnected to the beaded unit and the base.

FIG. 10 is a top view of the sub-assembly 54, in which the securing means 42, schematically shown, are actually at the bottom side of the insulating plate 55. Besides the sub-assembly 54, also the pins 29 of the base are shown. Usually, these pins 29 are situated on a circle. This Figure shows that the securing means 42 are fixed, for instance by welding at two positions. At one side, they are fixed to the pins 29, indicated by a welding spot 58, and at the other side, they are fixed to the insulating plate 55, indicated by the apertures 56 in the insulating plate. The other apertures 57 in the insulating plate are meant for interconnecting the electric leads coming from the beaded unit 33. Commonly, these electric leads are welded to the securing means 42, denoted by the welding spots 59.

The final electron gun, provided with a sub-assembly 54 as described above, is partly shown in FIG. 11. This Figure clearly reveals the connection between the securing means 44 (not visible in the Figure), 45–48 and the pins 29. It is also seen that the beaded unit 33 is supported by different supports 60. These supports are brackets that are beaded in the multiform rods on one side and welded to the pins 29 on the other side.

In summary this invention discloses a method of manufacturing an electron gun (6) having a sub-assembly (42) to interconnect the beaded unit (33) and the base (28) of the electron gun. This sub-assembly is manufactured by making a pattern of apertures (41) in a planar element (40), thereby forming a number of securing means (42). In the next step of the manufacturing process, portions of the securing means (42) are bent out of the plane of the planar element (40) and then connected to an insulating plate (55), thus forming the sub-assembly (54) of securing means (42) and insulating plate (55). This sub-assembly (42) is preferably provided with funnel-shaped apertures (57) to lead the electric leads of a number of the electrodes (20–24) of the electron gun (6) through the insulating plate (55). This allows an accurate and easy interconnection of leads and pins (29) of the base (28).

Electron guns manufactured by using this method will be cheaper, due to a higher degree of mechanization in the manufacturing process, but also the yield in the factory, and the performance will improve because mechanization of this process reduces the spread of a number of important parameters.

What is claimed is:

1. A method of manufacturing an electron gun having a beaded unit comprising a number of electrodes connected to electric leads and secured to beading rods, and a base comprising a number of pins, with the beaded unit and base connected by means of a sub-assembly of securing means and an insulating plate, that the method comprising;

providing a pattern of openings in a planar element, thereby forming a number of securing means, still planar-shaped, attached to a remainder of the planar element, bending portions of said securing means out of the plane of the planar element, to provide the securing means with a three dimensional shape, inserting the securing means into a plurality of first apertures of the insulating plate and secured therein, to form the sub-assembly, disconnecting the sub-assembly of securing means and insulating plate from the remainder of the planar element, and connecting the sub-assembly of securing means and insulating plate to the beaded unit and to the base to form the electron gun.

2. A method as claimed in claim 1, which further comprises; providing the insulating plate with a plurality of second apertures for leading through the electric leads of a number of the electrodes.

3. A method as claimed in claim 1, characterized in that the apertures in the insulating plate are funnel shaped.

4. A method as claimed in claim 2, characterized in that the first apertures in the insulating plate are tapered in a direction away from the base and the second apertures are tapered in a direction towards the base.

5. A method as claimed in claim 1, characterized in that the pattern of openings in the planar element is obtained by stamping the openings in the planar element.

6. An electron gun comprising: a beaded unit including a number of electrodes connected to electric leads and secured to beading rods, a base including a number of pins, the beaded unit and base being connected by means of a sub-assembly of securing means and an insulating plate, characterized in that the insulating plate includes a plurality of first apertures through which the securing means pass, and a plurality of second apertures through which pass the electric leads of a number of the electrodes, said electric leads being connected to the securing means which are connected to pins of the base.

7. An electron gun as claimed in claim 6, characterized in that the apertures in the insulating plate are funnel-shaped.

8. An electron gun as claimed in 7, characterized in that the first apertures in the insulating plate are tapered in a direction away from the base and the second apertures are tapered in a direction towards the base.

9. A sub-assembly for use in an electron gun, wherein the sub-assembly comprises securing means secured to an insulating plate which is provided with a plurality of first apertures through which the securing means pass, and a plurality of second apertures in the insulting plate, wherein the securing means includes at least one bendable planar element.

10. The sub-assembly as claimed in claim 9 wherein the securing means comprise at least one locking element integral with said planar element and twisted out of the plane of the planar element.

11. The sub-assembly as claimed in claim 9 wherein the second apertures in the insulating plate are adapted to engage electric leads extending from the electron gun, and the securing means comprise an electrically conductive material.

12. The method as claimed in claim 2 wherein the apertures in the insulating plate are funnel shaped.

13. The electron gun as claimed in claim 6 wherein the securing means includes at least one electrically conductive bendable planar element.

14. The electron gun as claimed in claim 6 wherein at least one of the securing means by itself provides a direct mechanical and electrical connection between at least one pin of the base and one of said electric leads.

15. The electron gun as claimed in claim 6 wherein the securing means includes at least one integral locking element of a size and shape to pass through one of said first apertures and physically located entirely on one surface of the insulating plate, wherein the locking element has a long axis parallel to the surface of the insulating plate.

16. The electron gun as claimed in claim 6 wherein the securing means is a solid member without an opening therein.

17. The electron gun as claimed in claim 6 wherein the securing means makes only outside surface contact with the pins of the base.

18. The electron gun as claimed in claim 6 wherein the securing means includes a plurality of conductive elements at least one of which extends between the base and the insulating plate and in close proximity to the base.

19. The electron gun as claimed in claim 6 wherein the securing means secures the base to the insulating plate in a manner substantially independent of the pins.

20. The electron gun as claimed in claim 6 wherein at least one of said pins is located external of the insulating plate.

* * * * *